US010186277B2

(12) United States Patent
Salishev

(10) Patent No.: US 10,186,277 B2
(45) Date of Patent: Jan. 22, 2019

(54) MICROPHONE ARRAY SPEECH ENHANCEMENT

(71) Applicant: INTEL CORPORATION, Santa Clara, CA (US)

(72) Inventor: Sergey I. Salishev, Saint-Petersburg (RU)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/545,286

(22) PCT Filed: Mar. 19, 2015

(86) PCT No.: PCT/IB2015/000476

§ 371 (c)(1),
(2) Date: Jul. 20, 2017

(87) PCT Pub. No.: WO2016/147020

PCT Pub. Date: Sep. 22, 2016

(65) Prior Publication Data

US 2018/0012616 A1 Jan. 11, 2018

(51) Int. Cl.

| | |
|---|---|
| ***G10L 21/0232*** | (2013.01) |
| ***G10L 25/21*** | (2013.01) |
| ***H04R 1/04*** | (2006.01) |
| ***H04R 3/00*** | (2006.01) |
| ***H04R 3/04*** | (2006.01) |
| ***G10L 21/0216*** | (2013.01) |
| ***H04R 1/40*** | (2006.01) |

(52) U.S. Cl.

CPC ..... *G10L 21/0232* (2013.01); *G10L 21/0216* (2013.01); *G10L 25/21* (2013.01); *H04R 1/04* (2013.01); *H04R 1/406* (2013.01); *H04R 3/005* (2013.01); *H04R 3/04* (2013.01); *G10L 2021/02166* (2013.01)

(58) Field of Classification Search

CPC ..... G10L 21/0232; G10L 25/21; G10L 2021/02166; G10L 21/0216; H04R 1/04; H04R 1/406; H04R 3/005; H04R 3/04

USPC ..... 381/92

See application file for complete search history.

(56) References Cited

U.S. PATENT DOCUMENTS

2001/0031053 A1* 10/2001 Feng ..... H04R 25/407 381/92

2009/0055170 A1 2/2009 Katsumasa

OTHER PUBLICATIONS

International Searching Authority at the European Patent Office, International Search Report and Written Opinion for International Patent Application No. PCT/IB2015/000476, dated Oct. 28, 2015, 14 pages.

* cited by examiner

*Primary Examiner* — Douglas Suthers

(74) *Attorney, Agent, or Firm* — Womble Bond Dickinson (US) LLP

(57) ABSTRACT

Speech received from a microphone array is enhanced. In one example, a noise filtering system receives audio from the plurality of microphones, determines a beamformer output from the received audio, applies a first auto-regressive moving average smoothing filter to the beamformer output, determines noise estimates from the received audio, applies a second auto-regressive moving average smoothing filter to the noise estimates, and combines the first and second smoothing filter outputs to produce a power spectral density output of the received audio with reduced noise.

19 Claims, 4 Drawing Sheets

MICROPHONE ARRAY SPEECH ENHANCEMENT

CROSS-REFERENCE TO RELATED APPLICATION

This patent application is a U.S. National Phase Application under 35 U.S.C. § 371 of International Application No. PCT/M2015/000476, filed Mar. 19, 2015, entitled MICROPHONE ARRAY SPEECH ENHANCEMENT.

FIELD

The present description relates to the field of audio processing and in particular to enhancing audio using signals from multiple microphones.

BACKGROUND

Many different devices offer microphones for a variety of different purposes. The microphones may be used to receive speech from a user to be sent to users of other devices. The microphones may be used to record voice memoranda for local or remote storage and later retrieval. The microphones may be used for voice commands to the device or to a remote system or the microphones may be used to record ambient audio. Many devices also offer audio recording and, together with a camera, offer video recording. These devices range from portable game consoles to smartphones to audio recorders to video cameras, to wearables, etc.

When the ambient environment, other speakers, wind, and other noises impact a microphone, a noise is created which may impair, overwhelm, or render unintelligible the rest of the audio signal. A sound recording may be rendered unpleasant and speech may not be recognizable for another person or an automated speech recognition system. While materials and structures have been developed to block noise, these typically require bulky or large structures that are not suitable for small devices and wearables. There are also software-based noise reduction systems that use complicated algorithms to isolate a wide range of different noises from speech or other intentional sounds and then reduce or cancel the noise.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

Figure 1:
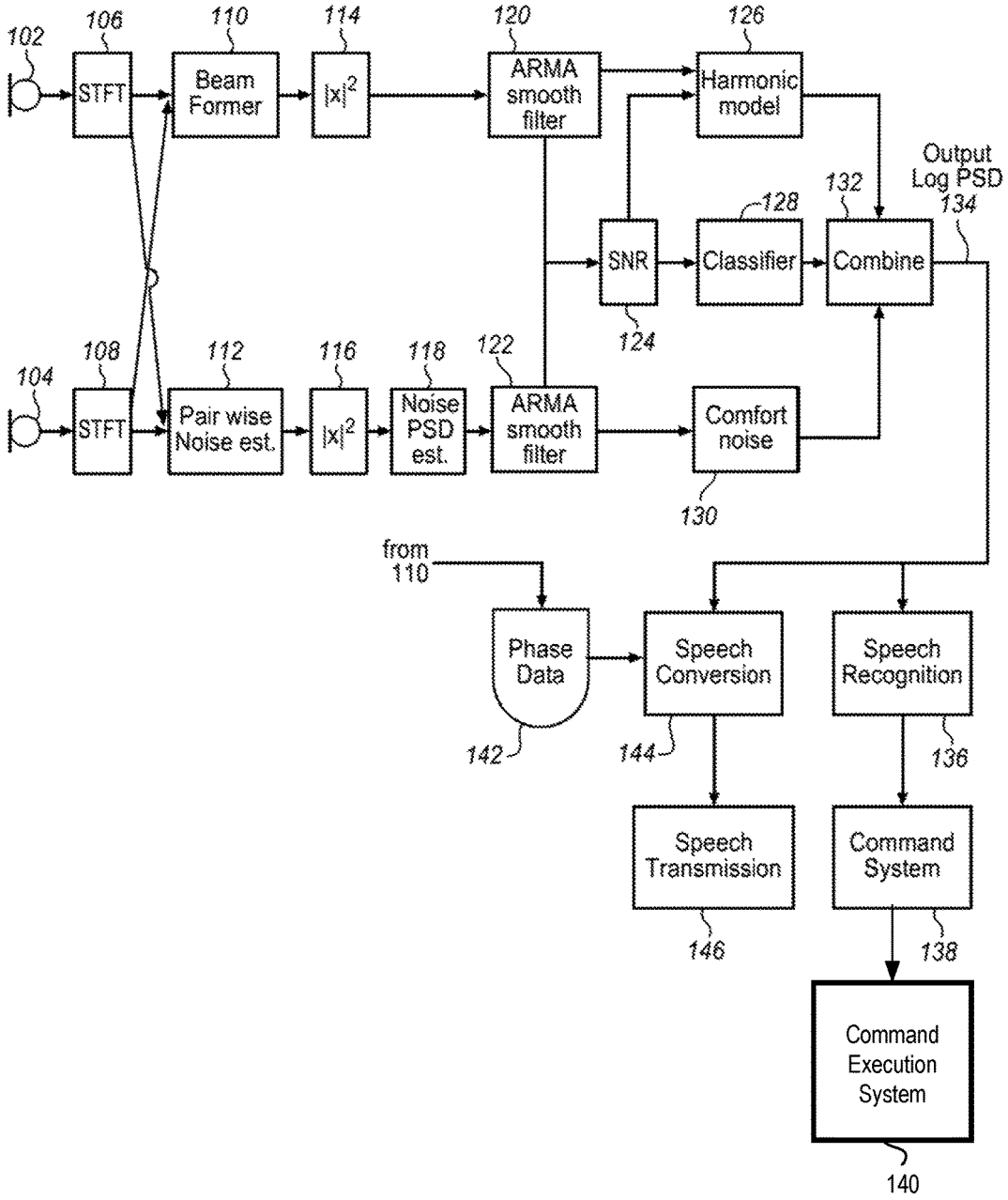
FIG. 1 is a block diagram of a speech enhancement system according to an embodiment.

A microphone array post-filter may be used for real-time on-line speech enhancement. Such a process is efficient for all sizes of microphone arrays including a dual microphone array. The filter is based on applying a binary classification model to a Log Short-Term Spectral Amplitude (Log-STSA). This technique allows for a substantial improvement of the recognition accuracy with only a minor increase in complexity compared to other types of post-filters and with a lower complexity compared to some voice model-based approaches.

A dual microphone array demonstrates an overall reduction in error rates for an automatic speech recognizer. There is also a substantial subjective noise reduction and intelligibility improvement without musical noise artifacts. Recognition accuracy is improved with an increased base (distance between the microphones) and with more microphones in an array. The described techniques may also demonstrate a substantially lower overall distance between the true log-spectral power of speech signal and the model output.

The post-filter as described herein does not assume that the speech signal and noise are stationary Gaussian processes. Instead, a classification approach is used based on stochastic properties of voice and noise signals taking into account the signal features used by speech recognition. A speech signal is a harmonic quasi-stationary process. It consists of a small number of steadily changing spectral components together with low amplitude wideband breath noise. In practice there are two significant types of noise, wideband noise, and speech-like noise. For wideband noise, the power of each spectral component of noise is small relative to the power of the speech spectral components. For speech-like noise, speech and noise almost always produce two disjoint combs in the spectral domain and can be separated. For both types of noise, noise suppression can be achieved by discarding spectral components not related to speech and replacing the discarded components with comfort noise.

As described herein, noise in a speech signal received from a microphone array may be suppressed using one or more techniques. Some of these techniques may be summarized, without limitation, as follows:

First, temporal Auto-Regressive Moving-Average (ARMA) smoothing filters with a look-ahead of e.g. 1 frame are used for each frequency bin of beamformer output and noise estimate Power Spectral Density (PSD).

These ARMA filters replace a causal Auto-Regressive (AR) single-pole filter with the transfer function $$(z) = \frac{1-\gamma}{1-\gamma z^{-1}}, \gamma$$

is a smoothing coefficient close to 1, which is commonly used for PSD smoothing. Because a causal AR filter may flatten attacks at the beginning of a word, an ARMA smoothing filter with look-ahead tracks a voice attack more faithfully. Such an ARMA smoothing filter adds some delay compared to an AR filter, however, the delay is small and for voice recognition tasks it is not significant in light of the existing delay caused by Voice Activity Detection (VAD).

Second, an optimal log-STSA (Short Term Spectral Amplitude) post-filter is used for the beamformer output as a model for harmonic components of the input speech signal. A log-STSA provides more accurate modelling of harmonic components of speech for recognition. The optimal log-STSA post-filter takes noise attenuation by the beamformer into account instead of ignoring it.

Third, a comfort noise model is used that is based on the beamformer output noise estimate and the expected variance of the breath noise. The comfort noise model may prevent noise over-suppression causing musical noise artifacts.

Fourth, a logistic regression soft binary classifier may be used for mixing harmonic and comfort noise models. This provides more accurate log-STSA estimates for a low-to-middle Signal to Noise Ratio (SNR) range compared to a multiplicative filter model alone.

By mixing comfort noise and harmonic models instead of generating additional recognizer confidence input based on classification, a variety of different recognizers may be used. The recognizer does not need to be adapted specifically to the noise reduction system.

An SNR-driven soft binary classification model is used for combining the harmonic model and the comfort noise model of the speech signal. The classification model may be expressed as follows:

$$\ln|\overline{S}|^2 = P_H(\xi)M_H + (1-P_H(\xi))M_N \quad \text{Eq. 1}$$

where $\ln|\overline{S}|^2$ is a log spectral power estimate of the voice signal, $\xi$ is the SNR, $P_H(\xi)$ is the probability of the corresponding voice harmonic component, $M_H$ is the log spectral power model of the harmonic components, and $M_N$ is a log spectral power model of comfort noise.

These low degree smoothing filters and simple soft classifier models may be used instead of high complexity GMM (Generalized Method of Movements)-based dynamic models to achieve similar recognition improvements. A pre-trained model may be used that doesn't require dynamic training. This allows the techniques described herein to be used in real-time.

A general context for speech enhancement is shown in FIG. 1. FIG. 1 is a block diagram of a noise reduction or speech enhancement system as described herein. The system has a microphone array. Two microphones 102, 104 of the array are shown but there may be more, depending on the particular implementation. Each microphone is coupled to an STFT (Short Term Fourier Transform) block 106, 108. The analog audio, such as speech, is received and sampled at the microphone. The microphone generates a stream of samples to the STFT block. The STFT blocks convert the time domain sample streams to frequency domain frames of samples. The sampling rate and frame size may be adapted to suit any desired accuracy and complexity. The STFT blocks determine a frame $\{X_i\}$ for each beamformer input (microphone sample stream) i=1 . . . n, where i is a stream from a particular microphone with n samples from 1 to n.

All of the frames determined by the STFT blocks are sent from the STFT blocks to a beamformer 110. In this example, the beamforming is assumed to be near-field. As a result, the voice is not reverberated. The beamforming may be modified to suit different environments, depending on the particular implementation. In the examples provided herein, the beam is assumed to be fixed. Beamsteering may be added, depending on the particular implementation. In the examples provided herein, voice and interference are assumed to be uncorrelated.

All of the frames are also sent from the STFT blocks to a pair-wise noise estimation block 112. The noise is assumed to be isotropic, which means a superposition of plane waves arriving at omni-directional sensors from various directions. The noise has a spatial correlation in the frequency domain $\Gamma_{ij}$ between microphones i and j.

For a spherically isotropic acoustic field and free standing microphones, the correlation between microphones may be estimated as follows:

$$\Gamma_{ij}(\omega) = \mathrm{sinc}\left(\frac{2\pi\omega d_{ij}}{c}\right), \ \mathrm{sinc}(x) = \frac{\sin x}{x}, \quad \text{Eq. 2}$$

where $\omega$ is the acoustic frequency, $d_{ij}$ is the distance between microphones, and c is the speed of sound. Spherical isotropy means that the virtual noise sources are uniformly distributed on the surface of the sphere, which closely corresponds to indoor reverberated noise such as office noise. This estimation may be performed for all microphones i,j from 1 to n where n is the number of microphones in the array.

For different acoustic fields, different models may be used to estimate the interference. For embedded microphones, the diffraction caused by the device in which the microphones are embedded may also be accounted for. $\Gamma_{ij}$ may be estimated from observations.

For STFT frame t and frequency bin $\omega$ the following model is used in this example. This model may be modified to suit different implementations and systems:

$$X_i = h_i S + N_i \quad \text{Eq. 3}$$

$$E(SN_i) = 0 \quad \text{Eq. 4}$$

$$E(N_i N_i) = |N|^2 \quad \text{Eq. 5}$$

$$E(N_i N_j) = \Gamma_{ij}|N|^2, \ i \neq j \quad \text{Eq. 6}$$

Where $X_i$ is the STFT frame t of noise from microphone i from the corresponding STFT block at frequency $\omega$. $h_i \epsilon C$ is the phase/amplitude shift of the speech signal in the microphone i at frequency $\omega$ and is used as a weighting factor. S is an idealized clean STFT frame t of the voice signal at frequency $\omega$. $N_i$ is an STFT frame t of noise from the microphone i at frequency $\omega$. E is the noise estimate.

Returning to FIG. 1, the beamformer output Y may be determined by block 110 in a variety of different ways. In one example, a weighted sum is taken over all microphones from 1 to n of each STFT frame using the weight $w_i$ determined from $h_i$ as follows:

$$w_i = (nh_i)^{-1} \quad \text{Eq. 7}$$

$$Y = \Sigma_{i=1}^{n} w_i X_i \quad \text{Eq. 8}$$

The microphone array may be used for a hands-free command system that is able to use directional discrimination. The beamformer exploits the directional discrimination of the array allowing for a reduction of undesired noise sources and allowing a speech source to be tracked. The beamformer output is later enhanced by applying a post-filter as described in more detail below.

At block 112 pairwise noise estimates $V_{ij}$ are determined. The pair-wise estimates may be determined using weighted differences of the STFT frames for each pair of microphones or in any other suitable way. If there are two microphones, then there is only one pair for each frame. If there are more than two microphones, then there will be more than one pair for each frame. The noise estimate is a weighted difference between the STFT noise frame from each microphone.

$$V_{ij} = w_i X_i - w_j X_j \quad \text{Eq. 9}$$

At block 114 the power spectral density (PSD) $|Y^t$51 $^2$ is determined for the beam former values and at block 116, the PSD $|V_{ij}^t|^2$ is determined for the pair-wise noise estimates.

At block 118, the PSD values $|V_{ij}^t|^2$ for the pair-wise noise estimates are used to determine an overall input noise PSD estimate $|\overline{N}|^2$. This may be done using a sum over i and j for all microphones 1-n of the PSD of the noise estimates each factored by the beamformer weights and corresponding interference.

$$|\overline{N}|^2 = \frac{2}{(n-1)n}\sum_{i=1}^{n-1}\sum_{j=i+1}^{n}\left(\frac{1}{|w_i|^2+|w_j|^2-2Re(w_i\overline{w}_j)\Gamma_{ij}}|V_{ij}|^2\right) \quad \text{Eq. 10}$$

An overall beamformer output noise PSD estimate may also be determined using the PSD Y from the beamformer.

$$|V|^2=E|Y-S|^2=\Sigma_{i=1}^{n}|w_i|^2+2\Sigma_{i=1}^{n-1}\Sigma_{j=i+i}^{n}Re(w_i\overline{w}_j)\Gamma_{ij})| \quad \text{Eq. 11}$$
$$\overline{N}|^2$$

At 120 and 122 $|\overline{Y}|^2$ and $|\overline{V}|^2$, respectively, may be determined using ARMA smoothing with a 1 frame look-ahead as described above.

At 124, the ARMA smoothing filter results for both the beamformer and the pair-wise noise estimation are applied to an SNR block to determine, for example, a Wiener filter gain G and a SNR $\xi$. This may be determined based on the difference in the PSD between the beam former values and the noise estimates as follows:

$$G = \frac{\max(\epsilon, |\overline{Y}|^2|\overline{V}|^2)}{|\overline{Y}|^2}, \xi = (G^{-1}-1)^{-1} \quad \text{Eq. 12}$$

Negative outlier values of $|\overline{Y}|^2-|\overline{V}|^2$ are replaced by small $\epsilon>0$.

This filter gain and SNR result is applied to a harmonic model at block 126 and to a classifier 128. The harmonic model uses the filter gain result G and SNR $\xi$ to determine an optimal estimate $M_H$ for a log-spectral power of the harmonic voice components. The following formula is a mathematical optimum estimate of log-STSA for a given observation and SNR. It combines the log of the PSD for the beamformer output with a log of the gain and an integral summand. In some embodiments, the integral summand may be removed for simplification with only a minor negative impact on the final result. Without integral summand the formula is equivalent to a Wiener filter in a log-spectral domain.

$$M_H = \ln|Y|^2 + 2\ln G + \int_{\xi}^{\infty}\frac{e^{-x}}{x}dx \quad \text{Eq. 13}$$

At 128, a signal Bayesian probability is determined using a logistic regression classifier with parameters $\beta_0$, $\beta_1$ based on the SNR $\xi$ as follows:

$$P_H(\xi) = \frac{1}{1+e^{-(\beta_0+\beta_1\ln\xi)}} \quad \text{Eq. 14}$$

At 130, the ARMA smoothed noise estimates from block 122 are used to model a comfort noise $M_N$. This may be done in any of a variety of different ways. In this example, $\sigma_0^2$ is used as the expected variance of the breath noise, which is dependent on the expected loudness of the voice. This is a weighted average of a logarithm of the pair-wise noise V PSD and a logarithm of the breath noise variance with a weight $\alpha$.

$$M_N=\alpha \ln |\overline{V}|^2+(1-\alpha)\ln \sigma_0^2 \quad \text{Eq. 15}$$

At 132, the harmonic model $M_H$ from block 126, the probability $P_H$ from block 128 and the comfort noise $M_N$ from block 130 are combined to determine an output Log-PSD. This may be determined by combining the values as follows:

$$\ln |\overline{S}|^2=P_H(\xi)M_H+(1-P_H(\xi))M_N \quad \text{Eq. 16}$$

The probability $P_H$ is applied to scale the harmonic model noise $M_H$ and the comfort noise $M_N$. As a result, the classifier function determines which factor prevails in the output Log-PSD.

System parameters $\alpha$, $\beta_0$, $\beta_1$, $\sigma_0^2$, and ARMA filter coefficients may be optimized beforehand for the best recognition accuracy for a particular system configuration and for expected uses. In some embodiments coordinate gradient descent is applied to a representative database of speech and noise samples. Such a database may be generated using recordings of user speech or a pre-existing source of speech samples may be used such as TIDIGITS (from the Linguistic Data Consortium). The database may be extended by adding random segments of noise data to the speech samples.

The noise suppression system described herein may be used for improving speech recognition in many different types of devices with microphone arrays including head-mounted wearable devices, mobile phones, tablets, ultra-books and notebooks. As described herein, a microphone array is used. Speech recognition is applied to the speech received by the microphones. The speech recognition applies post-filtering and beamforming to sampled speech. In addition to beamforming the microphone array is used for estimating SNR and post-filtering so that strong noise attenuation is provided. In the post-filter, a logarithmic filter in addition to a multiplicative filter is used.

Output log-PSD 134 may be applied to a speech recognition system or to a speech transmission system or both, depending on the particular implementation. For the command system, the output 134 may be applied directly to a speech recognition system 136. The recognized speech may then be applied to a command system 138 to determine a command or request contained in the original speech from the microphones. The command may then be applied to a command execution system 140 such a processor or transmission system. The command may be for local execution or the command may be sent to another device for execution remotely on the other device.

For a human interface, the output-log PSD may be combined with phase data 142 from the beamformer output 112 to convert the PSD 134 to speech 144 in a speech conversion system. This speech audio may then be transmitted or rendered in a transmission system 146. The speech may be rendered locally to a user or sent using a transmitter to another device, such as a conference or, voice call terminal.

Figure 2:
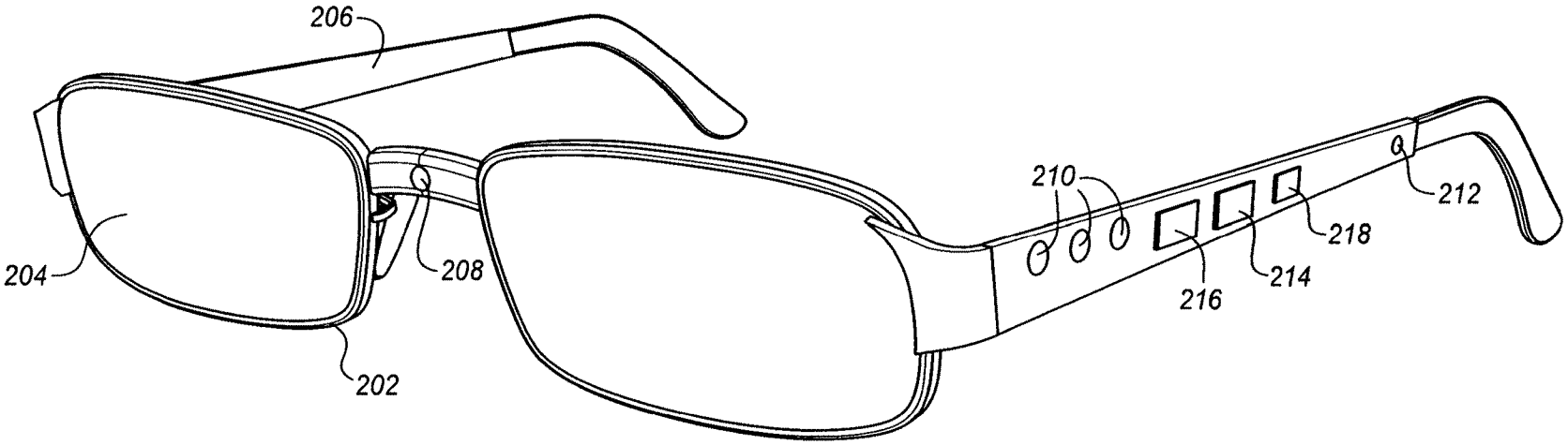
FIG. 2 is a diagram of a user device suitable for use with a speech enhancement system according to an embodiment.

FIG. 2 is a diagram of a user device that may use noise reduction with multiple microphones for speech recognition and for communication with other users. The device has a frame or housing 202 that carries some or all of the components of the device. The frame carries lenses 204 one for each of the user's eyes. The lenses may be used as a projection surface to project information as text or images in front of the user. A projector 216 receives graphics, text, or other data and projects this onto the lens. There may be one or two projectors depending on the particular implementation.

The user device also includes one or more cameras 208 to observe the environment surrounding the user. In the illustrated example there is a single front camera. However, there may be multiple front cameras for depth imaging, side cameras and rear cameras.

The system also has a temple 206 on each side of the frame to hold the device against a user's ears. A bridge of the frame holds the device on the user's nose. The temples carry one or more speakers 212 near the user's ears to generate audio feedback to the user or to allow for telephone communication with another user. The cameras, projectors, and speakers are all coupled to a system on a chip (SoC) 214. This system may include a processor, graphics processor, wireless communication system, audio and video processing systems, and memory, inter alia. The SoC may contain more or fewer modules and some of the system may be packaged as discrete dies or packages outside of the SoC. The audio processing described herein including noise reduction, speech recognition, and speech transmission systems may all be contained within the SoC or some of these components may be discrete components coupled to the SoC. The SoC is powered by a power supply 218, such as a battery, also incorporated into the device.

The device also has an array of microphones 210. In the present example, three microphones are shown arrayed across a temple 206. There may be three more microphones on the opposite temple (not visible) and additional microphones in other locations. The microphones may instead all be in different locations than that shown. More or fewer microphones may be used depending on the particular implementation. The microphone array may be coupled to the SoC directly or through audio processing circuits such as analog to digital converters, Fourier transform engines and other devices, depending on the implementation.

The user device may operate autonomously or be coupled to another device, such as a tablet or telephone using a wired or wireless link. The coupled device may provide additional processing, display, antenna or other resources to the device. Alternatively, the microphone array may be incorporated into a different device such as a tablet or telephone or stationary computer and display depending on the particular implementation.

Figure 3:
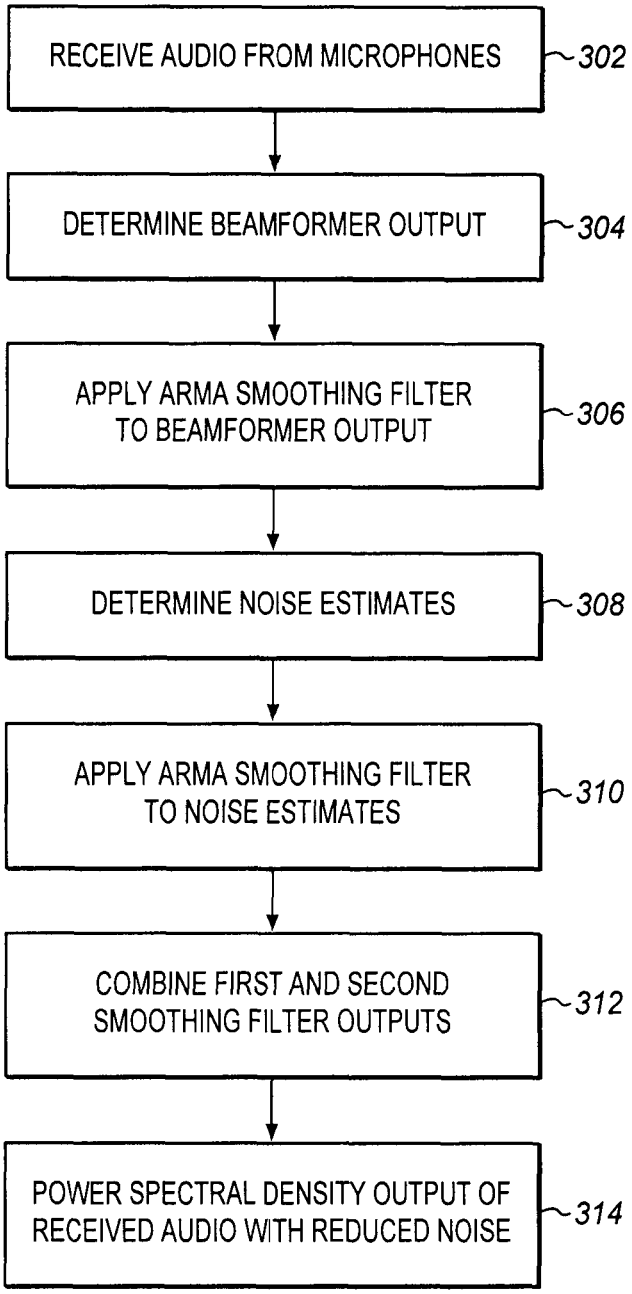
FIG. 3 is a process flow diagram of enhancing speech according to an embodiment.

FIG. 3 is a simplified process flow diagram of the basic operations performed by the system of FIG. 1. This method of filtering audio from a microphone array may have more or fewer operations. Each of the illustrated operations may include many additional operations, depending on the particular implementation. The operations may be performed in a single audio processor or central processor or the operations may be distributed to multiple different hardware or processing devices.

At 302 audio is received from a microphone array. While pair of microphones is described with respect to FIG. 1 and a six microphone array is described with respect to FIG. 2, there may be more or fewer depending on the intended use for the device. The received audio may take many different forms. In the described examples, the audio is converted to STFT frames, however, embodiments are not so limited.

At 304, a beamformer output is determined from the received audio. At 306 an ARMA smoothing filter is applied to the beamformer output. Similarly at 308, noise estimates are determined from the received audio and at 310 a second ARMA smoothing filter is applied to the noise estimates. These ARMA smoothing filters may operate on a preprocessed version of the beamformer and noise estimates. The preprocessing may include determining various PSD values.

At 312, the first and second smoothing filter outputs are combined to produce a power spectral density output of the received audio with reduced noise. The result at 314 is a PSD of the received audio with reduced noise.

The combining may be done by classifying the audio or the smoothing filter results and then combining based on the results of the classification. The classifier is described in more detail above.

Figure 4:
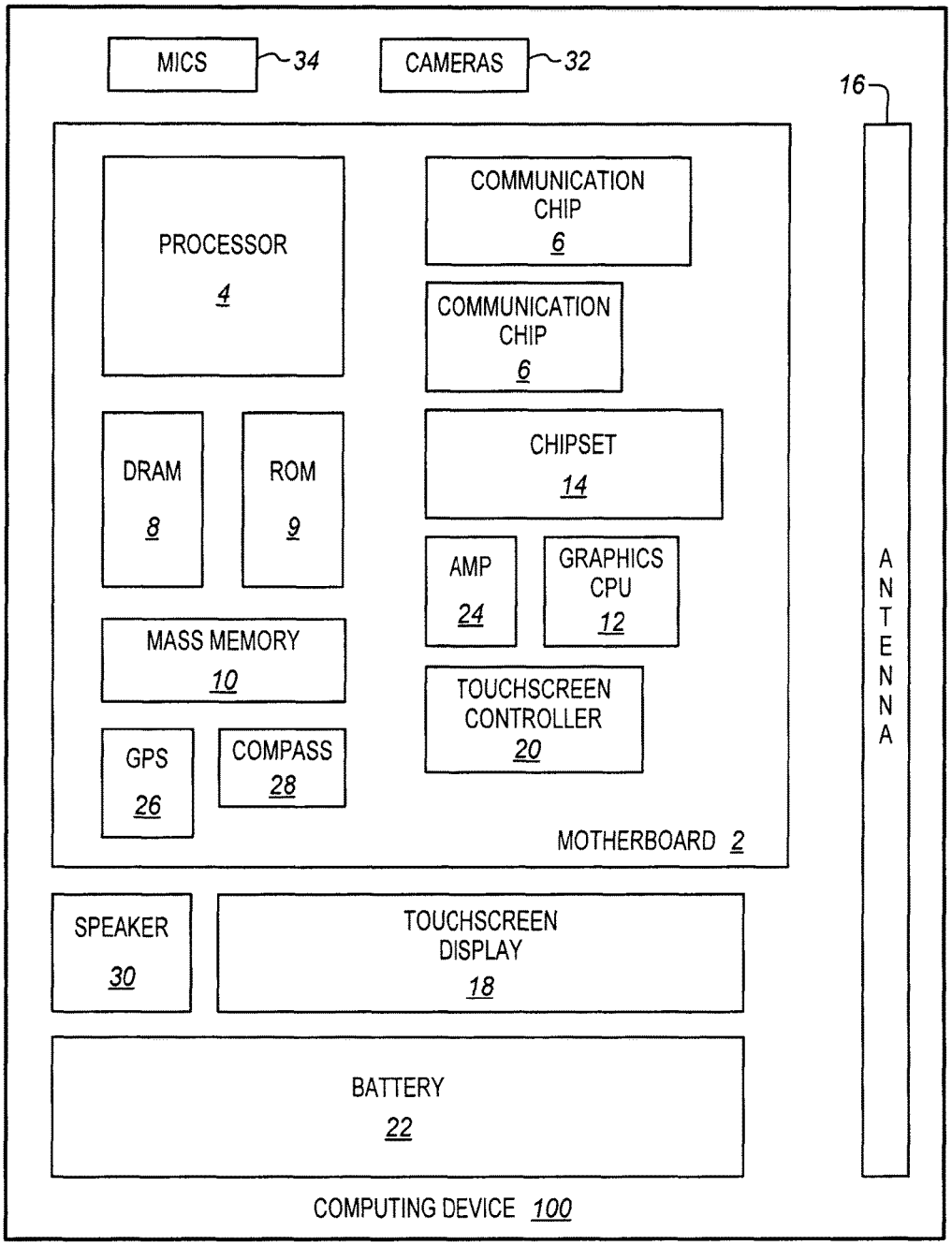
FIG. 4 is a block diagram of a computing device incorporating speech enhancement according to an embodiment.

FIG. 4 is a block diagram of a computing device 100 in accordance with one implementation. The computing device may have a form factor similar to that of FIG. 2, or it may be in the form of a different wearable or portable device. The computing device 100 houses a system board 2. The board 2 may include a number of components, including but not limited to a processor 4 and at least one communication package 6. The communication package is coupled to one or more antennas 16. The processor 4 is physically and electrically coupled to the board 2.

Depending on its applications, computing device 100 may include other components that may or may not be physically and electrically coupled to the board 2. These other components include, but are not limited to, volatile memory (e.g., DRAM) 8, non-volatile memory (e.g., ROM) 9, flash memory (not shown), a graphics processor 12, a digital signal processor (not shown), a crypto processor (not shown), a chipset 14, an antenna 16, a display 18 such as a touchscreen display, a touchscreen controller 20, a battery 22, an audio codec (not shown), a video codec (not shown), a power amplifier 24, a global positioning system (GPS) device 26, a compass 28, an accelerometer (not shown), a gyroscope (not shown), a speaker 30, a camera 32, a microphone array 34, and a mass storage device (such as hard disk drive) 10, compact disk (CD) (not shown), digital versatile disk (DVD) (not shown), and so forth). These components may be connected to the system board 2, mounted to the system board, or combined with any of the other components.

The communication package 6 enables wireless and/or wired communications for the transfer of data to and from the computing device 100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 6 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 100 may include a plurality of communication packages 6. For instance, a first communication package 6 may be dedicated to shorter range wireless communications such as Wi-Fi and Bluetooth and a second communication package 6 may be dedicated to longer range wireless communications such as GPS, EDGE, GPRS, CDMA, WiMAX, LTE, Ev-DO, and others.

The microphones 34 and the speaker 30 are coupled to an audio front end 36 to perform digital conversion, coding and decoding, and noise reduction as described herein. The processor 4 is coupled to the audio front end to drive the process with interrupts, set parameters, and control operations of the audio front end. Frame-based audio processing may be performed in the audio front end or in the communication package 6.

In various implementations, the computing device 100 may be eyewear, a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 100 may be any other electronic device that processes data.

Embodiments may be implemented as a part of one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to a method of filtering audio from a microphone array that includes receiving audio from a plurality of microphones, determining a beamformer output from the received audio, applying a first auto-regressive moving average smoothing filter to the beamformer output, determining noise estimates from the received audio, applying a second auto-regressive moving average smoothing filter to the noise estimates, and combining the first and second smoothing filter outputs to produce a power spectral density output of the received audio with reduced noise.

Further embodiments include applying speech recognition to the power spectral density output to recognize a statement in the received audio.

Further embodiments include combining the power spectral density output with phase data to generate an audio signal containing speech with reduced noise.

Further embodiments include determining a harmonic noise model using the first smoothing filter and wherein combining comprises combining the harmonic noise model, wherein the harmonic noise model is determined by determining an estimate for a log spectral power of harmonic voice components of a gain from the first smoothing filter.

In further embodiments determining an estimate for a log spectral power comprises combining a log of the power spectral density of the beamformer output with a log of the gain from the first smoothing filter.

Further embodiments include determining a comfort noise using the second smoothing filter and wherein combining comprises combining the comfort noise, wherein the comfort noise is determined by applying a function of the second smoothing filter output with a function of breath noise.

In further embodiments the function of the second smoothing filter is a logarithmic function and wherein the function of breath noise is a logarithmic function.

In further embodiments the function of the smoothing filter is factored by a weight, $\alpha$, and the function of the breath noise is factored by $1-\alpha$.

In further embodiments combining comprises combining in accordance with a classifier.

In further embodiments the classifier scales a difference between the first and second smoothing filter outputs.

In further embodiments the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination.

In further embodiments determining comprises applying a logistic regression to a signal to noise ratio.

In further embodiments determining a beamformer output comprises converting the received audio to short term Fourier transform audio frames and taking a weighted sum of each frame over each microphone.

In further embodiments the weight of the weighted sum differs for each microphone.

Some embodiments pertain to a machine-readable medium having instructions stored thereon that, when operated on by the machine, cause the machine to perform operations that include receiving audio from a plurality of microphones, determining a beamformer output from the received audio, applying a first auto-regressive moving average smoothing filter to the beamformer output, determining noise estimates from the received audio, applying a second auto-regressive moving average smoothing filter to the noise estimates, and combining the first and second smoothing filter outputs to produce a power spectral density output of the received audio with reduced noise.

Further embodiments include applying speech recognition to the power spectral density output to recognize a statement in the received audio.

Further embodiments include combining the power spectral density output with phase data to generate an audio signal containing speech with reduced noise.

Further embodiments include determining a harmonic noise model using the first smoothing filter and wherein combining comprises combining the harmonic noise model, wherein the harmonic noise model is determined by determining an estimate for a log spectral power of harmonic voice components of a gain from the first smoothing filter.

Further embodiments include determining a comfort noise using the second smoothing filter and wherein combining comprises combining the comfort noise, wherein the comfort noise is determined by applying a function of the second smoothing filter output with a function of breath noise.

In further embodiments the function of the second smoothing filter is a logarithmic function factored by a weight, $\alpha$, and wherein the function of breath noise is a logarithmic function factored by $1-\alpha$.

In further embodiments combining comprises combining in accordance with a classifier that scales a difference between the first and second smoothing filter outputs.

In further embodiments the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination.

Some embodiments pertain to an apparatus that includes a microphone array, and a noise filtering system to receive audio from the plurality of microphones, determine a beamformer output from the received audio, apply a first auto-regressive moving average smoothing filter to the beamformer output, determine noise estimates from the received audio, apply a second auto-regressive moving average smoothing filter to the noise estimates, and combine the first and second smoothing filter outputs to produce a power spectral density output of the received audio with reduced noise.

Further embodiments include a speech recognition system to receive the power spectral density output and to recognize a statement in the received audio.

Further embodiments include a speech conversion system to combine the power spectral density output with phase data to generate an audio signal containing speech with reduced noise and a speech transmitter to transmit the audio signal to a remote device.

In further embodiments the noise filtering system further determines a comfort noise using the second smoothing filter and wherein combining comprises combining the comfort noise, wherein the comfort noise is determined by applying a function of the second smoothing filter output with a function of breath noise.

In further embodiments determining a beamformer output comprises converting the received audio to short term Fourier transform audio frames and taking a weighted sum of each frame over each microphone.

In further embodiments the weight of the weighted sum differs for each microphone.

Some embodiments pertain to a wearable device that includes a frame configured to be worn by a user, a microphone array connected to the frame, and a noise filtering system connected to the frame to receive audio from the plurality of microphones, determine a beamformer output from the received audio, apply a first auto-regressive moving average smoothing filter to the beamformer output, determine noise estimates from the received audio, apply a second auto-regressive moving average smoothing filter to the noise estimates, and combine the first and second smoothing filter outputs to produce a power spectral density output of the received audio with reduced noise.

In further embodiments the noise filtering system is further to determine a comfort noise using the second smoothing filter and wherein combining comprises combining the comfort noise, wherein the comfort noise is determined by applying a function of the second smoothing filter output with a function of breath noise.

In further embodiments the function of the second smoothing filter is a logarithmic function factored by a weight, $\alpha$, and wherein the function of breath noise is a logarithmic function factored by $1-\alpha$.

In further embodiments combining comprises combining in accordance with a classifier that scales a difference between the first and second smoothing filter outputs.

In further embodiments the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination by applying a logistic regression to a signal to noise ratio.

The invention claimed is:

1. A method of filtering audio from a microphone array comprising:

receiving audio from a plurality of microphones;

determining a beamformer output from the received audio;

applying a first auto-regressive moving average smoothing filter to the beamformer output, including determining a harmonic noise model using the first smoothing filter, wherein the harmonic noise model is determined by determining an estimate for a log spectral power of harmonic voice components of a gain from the first smoothing filter;

determining noise estimates from the received audio;

applying a second auto-regressive moving average smoothing filter to the noise estimates; and combining the first and second smoothing filter outputs, which includes the harmonic noise model, to produce a power spectral density output of the received audio with reduced noise.

2. The method of claim 1, wherein determining the estimate for a log spectral power comprises combining a log of the power spectral density of the beamformer output with a log of the gain from the first smoothing filter.

3. The method of claim 1, further comprising determining a comfort noise using the second smoothing filter and wherein combining comprises combining the comfort noise as the second smoothing filter output, wherein the comfort noise is determined by applying a function of the second smoothing filter output with a function of breath noise.

4. The method of claim 3, wherein the function of the second smoothing filter is a logarithmic function and wherein the function of breath noise is a logarithmic function.

5. The method of claim 4, wherein the function of the smoothing filter is factored by a weight, $\alpha$, and the function of the breath noise is factored by $1-\alpha$.

6. The method of claim 1, wherein combining comprises combining in accordance with a classifier that scales a difference between the first and second smoothing filter outputs.

7. The method of claim 6, wherein the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination.

8. The method of claim 7, wherein determining comprises applying a logistic regression to a signal to noise ratio.

9. The method of claim 1, wherein determining a beamformer output comprises converting the received audio to short term Fourier transform audio frames and taking a weighted sum of each frame over each microphone.

10. The method of claim 9, wherein weight of the weighted sum differs for each microphone.

11. A non-transitory machine-readable medium having instructions stored thereon that, when operated on by the machine, cause the machine to perform operations comprising:

receiving audio from a plurality of microphones;

determining a beamformer output from the received audio;

applying a first auto-regressive moving average smoothing filter to the beamformer output, including determining a harmonic noise model using the first smoothing filter, wherein the harmonic noise model is determined by determining an estimate for a log spectral power of harmonic voice components of a gain from the first smoothing filter;

determining noise estimates from the received audio;

applying a second auto-regressive moving average smoothing filter to the noise estimates; and combining the first and second smoothing filter outputs, which includes the harmonic noise model, to produce a power spectral density output of the received audio with reduced noise.

12. The medium of claim 11, wherein combining comprises combining in accordance with a classifier that scales a difference between the first and second smoothing filter outputs.

13. The medium of claim 12, wherein the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination.

14. An apparatus comprising:

a microphone array comprising a plurality of microphones; and a noise filtering system to receive audio from the plurality of microphones, determine a beamformer output from the received audio, apply a first auto-regressive moving average smoothing filter to the beamformer output, determine noise estimates from the received audio, apply a second auto-regressive moving average smoothing filter to the noise estimates, and combine the first and second smoothing filter outputs to produce a power spectral density output of the received audio with reduced noise, wherein the noise filtering system is operable to apply a first auto-regressive moving average smoothing filter to the beamformer output to determine a harmonic noise model by determining an estimate for a log spectral power of harmonic voice components of a gain from the first smoothing filter.

15. The apparatus of claim 14, further comprising a speech recognition system to receive the power spectral density output and to recognize a statement in the received audio.

16. The apparatus of claim 14, further comprising a speech conversion system to combine the power spectral density output with phase data to generate an audio signal containing speech with reduced noise and a speech transmitter to transmit the audio signal to a remote device.

17. A wearable device comprising:

a frame configured to be worn by a user;

a microphone array connected to the frame and comprising a plurality of microphones; and a noise filtering system connected to the frame to receive audio from the plurality of microphones, determine a beamformer output from the received audio, apply a first auto-regressive moving average smoothing filter to the beamformer output, determine noise estimates from the received audio, apply a second auto-regressive moving average smoothing filter to the noise estimates, and combine the first and second smoothing filter outputs to produce a power spectral density output of the received audio with reduced noise, wherein the noise filtering system is operable to apply a first auto-regressive moving average smoothing filter to the beamformer output to determine a harmonic noise model by determining an estimate for a log spectral power of harmonic voice components of a gain from the first smoothing filter.

18. The device claim 17, wherein combining comprises combining in accordance with a classifier that scales a difference between the first and second smoothing filter outputs.

19. The device of claim 18, wherein the first smoothing filter output is converted to a harmonic noise and the second smoothing filter output is converted to a comfort noise and wherein the classifier determines whether the harmonic noise or the comfort noise prevails in the received audio and combines the harmonic noise and the comfort noise with the received audio based on the determination by applying a logistic regression to a signal to noise ratio.

* * * * *